United States Patent [19]

Ebihara et al.

[11] 3,956,959

[45] May 18, 1976

[54] ELECTRONIC PERCUSSION INSTRUMENT

[75] Inventors: Tomoo Ebihara, Mooka; Motonobu Serizawa, Mibu, both of Japan

[73] Assignee: Sanyo Silicon Electronics Co., Ltd., Mooka, Japan

[22] Filed: Feb. 20, 1975

[21] Appl. No.: 551,304

[30] Foreign Application Priority Data

Apr. 30, 1974 Japan ..... 49-49704[U]

[52] U.S. Cl. ..... 84/1.15; 84/1.13; 84/1.26; 84/DIG. 8; 84/DIG. 12

[51] Int. Cl.[2] ..... G10H 1/02; G10H 5/00

[58] Field of Search ..... 84/1.01, 1.04, 1.14, 84/1.15, 1.24, DIG. 7, DIG. 8, DIG. 12, 1.13, 1.26

[56] References Cited

UNITED STATES PATENTS

| | | | |
|---|---|---|---|
| 2,879,685 | 3/1959 | Page | 84/DIG. 7 |
| 3,439,568 | 4/1969 | Griffith | 84/1.01 |
| 3,509,264 | 4/1970 | Green | 84/1.15 |
| 3,549,775 | 12/1970 | Kaminsky | 84/DIG. 12 |
| 3,551,580 | 12/1970 | Glenn et al. | 84/DIG. 12 |
| 3,553,339 | 1/1971 | Dominguez et al. | 84/1.15 |
| 3,590,133 | 6/1971 | Schwartz et al. | 84/1.24 |
| 3,659,032 | 4/1972 | May | 84/1.04 |
| 3,725,561 | 4/1973 | Paul | 84/1.15 |
| 3,748,367 | 7/1973 | Lamme et al. | 84/1.04 |
| 3,749,810 | 7/1973 | Dow | 84/1.24 |

OTHER PUBLICATIONS

T. W. Collins et al., "Hall Effect In Magnetic Core Keyboard", IBM Technical Disclosure Bulletin, Vol. 13, No. 1, June 1970, p. 189.

*Primary Examiner*—L. T. Hix
*Assistant Examiner*—Stanley J. Witkowski
*Attorney, Agent, or Firm*—Woodhams, Blanchard and Flynn

[57] ABSTRACT

When a beating force is applied to a beat plate having a magnet attached to the lower surface thereof, an output responsive to the strength and application speed of the beating force is produced in a sensing means comprised by a Hall element disposed below the magnet. The output is used for controlling an oscillation circuit for generating a percussion instrument sound signal and an output therefrom is converted into a percussion instrument sound by means of a speaker.

7 Claims, 6 Drawing Figures

ELECTRONIC PERCUSSION INSTRUMENT

BACKGROUND OF THE INVENTION

This invention relates to percussion instruments such as a bongo, conga and drum, and more particularly to an electronic percussion instrument whose sound generating means is constituted by an electric circuit.

An electronic percussion instrument of this type has conventionally been available wherein when a beat plate is applied with a beating force, a switch disposed below the beat plate is actuated to produce a signal in the form of pulse which in turn enables an oscillator circuit to generate an output therefrom. However, the output of the oscillation circuit was preselected irrespective of tone quality and volume of sounds produced through the beat plate and accordingly it was constant without relating to the strength and application speed of the beating force, i.e. the amplitude and width of the pulse signal. For this reason, even when the strength and application speed of the beating force were varied, obtainable sounds were almost uniform or if enriched with slight piano and forte expressions, they were not in a clear tone.

On account of the aforementioned disadvantages, the conventional electronic percussion instrument per se was unable to produce various sounds such as of low-pitched tone, high-pitched tone and glissando tone. Therefore, for a practical performance, it was necessary to arrange a plurality of electronic percussion instruments exclusively used for a specific sound.

Further, beginners in attempting to produce soft and continuous sounds often suffered from fluctuations in the strength of sound and it was necessary for players to be highly skilled in order to succeed in producing, by the application of a fine beating force, uniform strength sounds without fail.

SUMMARY OF THE INVENTION

An object of the invention is to eliminate these disadvantages of the prior art electronic percussion instrument and to provide an improved electronic percussion instrument capable of producing sounds clear in tone and responsive to the strength and application speed of a beating force, i.e. closely imitative of sounds of original percussion instruments, by controlling an oscillation circuit by means of an output signal of a sensing means comprised by a Hall element, which output signal reflects the beating force.

Another object of the invention is to provide an improved electronic percussion instrument capable of by itself producing various sounds different from each other in tone quality and tone colour, and specifically wherein beat plates are sectioned into five components, a central component of which is for glissando and surrounded by other four components for low conga, high conga, low bongo and high bongo, whereby by applying a beating force to any one of the beat plates sounds of conga and bongo are expressed in variety of tone quality and tone colour, thereby giving tasteful tones to the percussion instrument as a monotonous rhythm instrument.

Still another object of the invention is to provide an improved percussion instrument which can be applicable to drums such that bass, middle and side drums as well as the snare drum are constituted, thereby being not only suitable for toys and teaching instruments but also available for practical performance use.

Still another object of the invention is to provide an improved percussion instrument wherein there is further provided a resilient material disposed below the beat plate, and the beat plate and the resilient material are brought into contact through a looped projection provided by either the beat plate or resilient material, the resilient material having a cushion effect against the beat plate by the aid of the looped projection and enabling the displacement of beat plate to be substantially constant even when a slightly different amount of fine beating force is applied to the beat plate so that substantially uniform strength of sounds can be produced, whereby no sophisticated control is necessitated for the application of beating force and even beginners, as far as they apply a fine beating force to the beat plate, can produce continuously sounds at a uniform strength without resort to any special skill.

Yet still another object of the invention is to provide an improved electronic percussion instrument wherein the resilient material is made of soft synthetic resin in order that finger tip movements by players are sensed with high fidelity, whereby the displacement of the beat plate is sensed accurately, the resilient material other than metal resilient materials cannot be a source of noises, will undergo no elastic fatigue under long time use without failing to be in a virgin state, and will be easy for its mounting and adjusting.

The invention can be more fully understood from the following detailed description taken in conjunction with the accompanying drawings in which.

DETAILED DESCRIPTION OF THE PREFERRED EMBODIMENT

With reference to accompanying drawings, one embodiment of the invention will be described.

Figure 1:
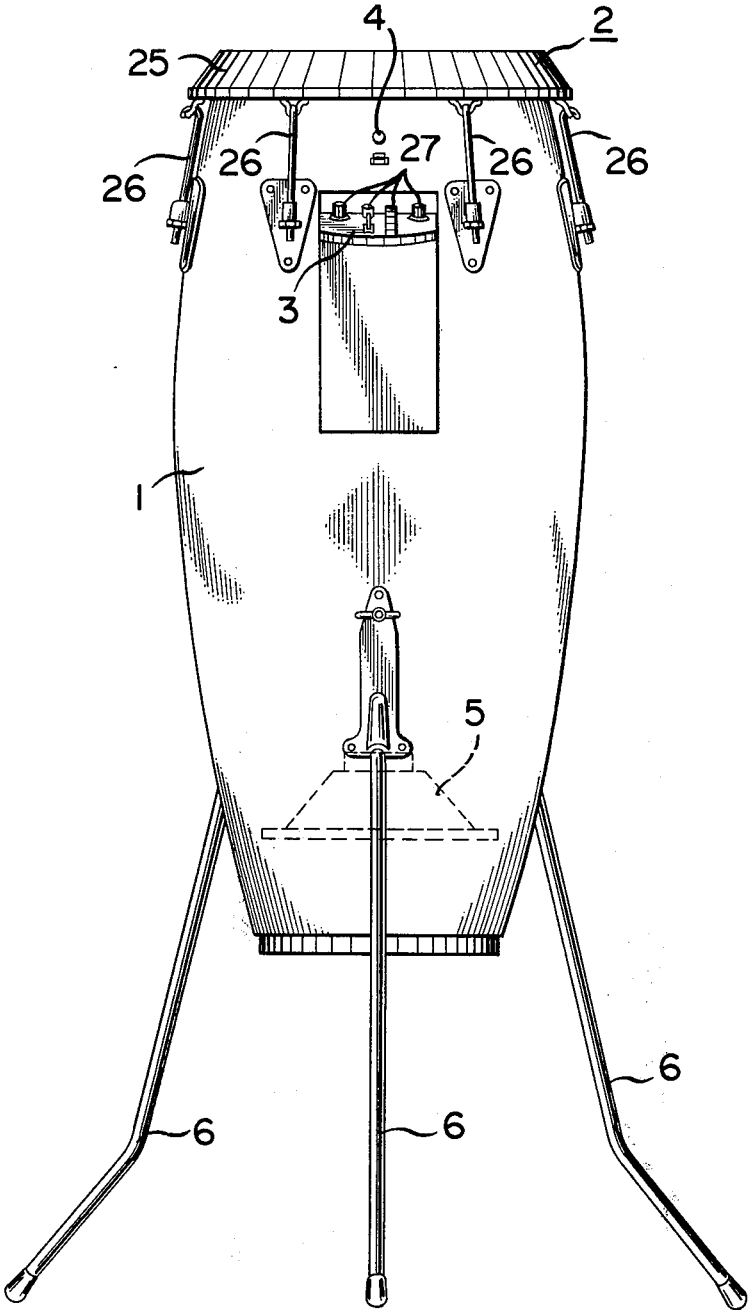
FIG. 1 is a front view of an electronic percussion instrument according to the invention.

Reference is made to FIG. 1 wherein numeral 1 designates a wooden instrument body taking the form of a conga drum, for example. On the upper end portion of body 1 is attached a sensing means 2, and to the side portion thereof are attached an operation means 3 and a pilot lamp 4. Inside the body 1 are mounted an electric circuit and a speaker 5. In addition thereto, it is preferable for the body to be provided on the outside thereof with a means of volume control (not shown) at the height corresponding to that of a player's knee who is standing on the floor. There are further provided legs 6 for supporting the body 1.

Figure 2:
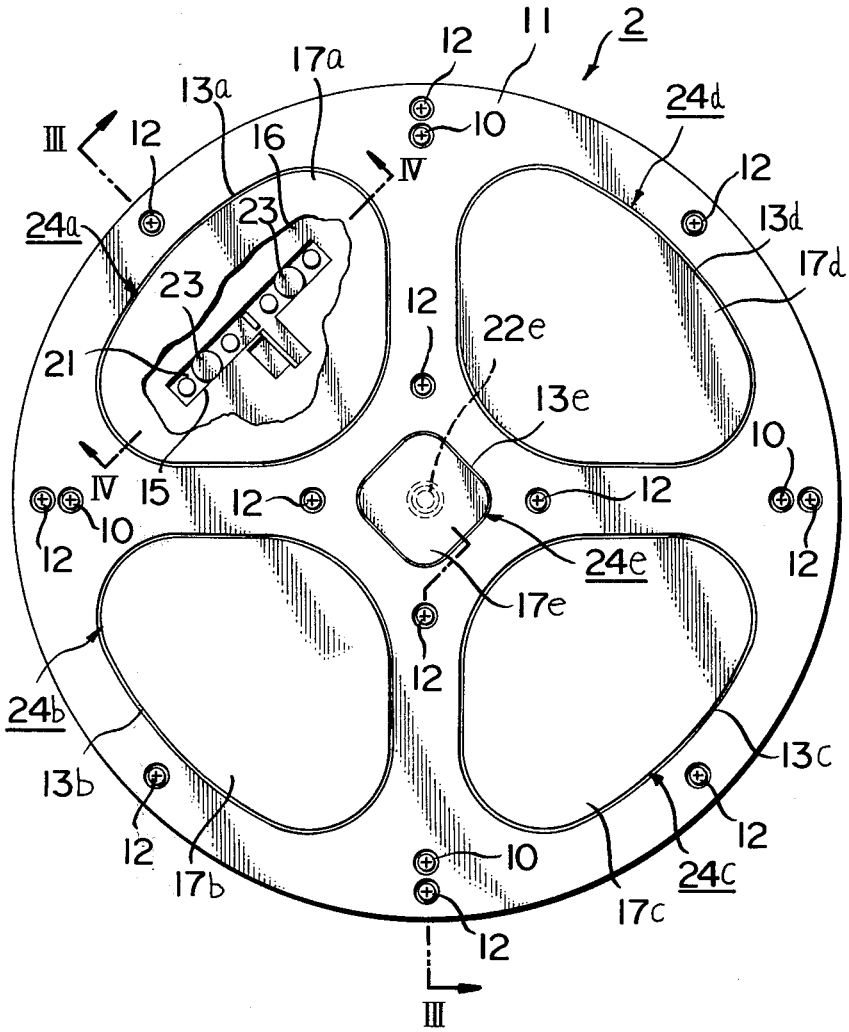
FIG. 2 is an enlarged plane view of the electronic percussion instrument shown in FIG. 1 when a cover is removed.
Figure 3:
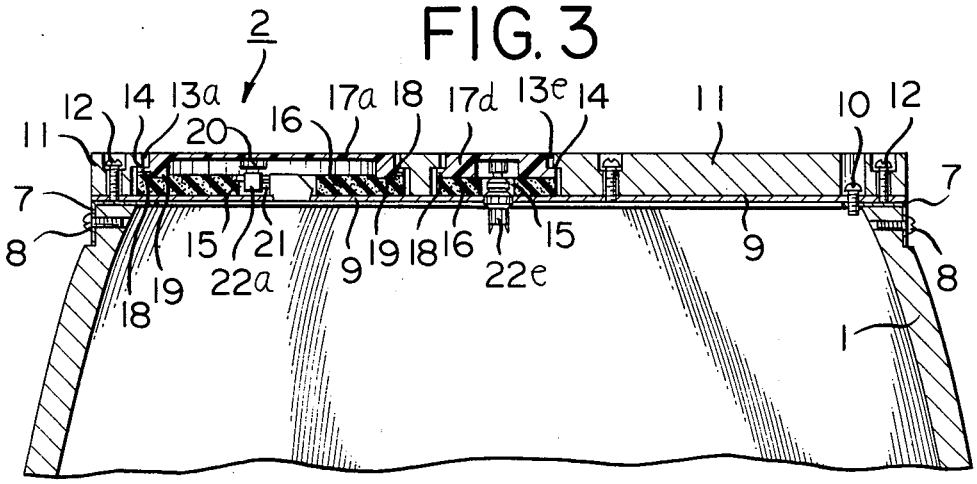
FIG. 3 is a longitudinal section view of FIG. 2 taken on line III—III.
Figure 4:
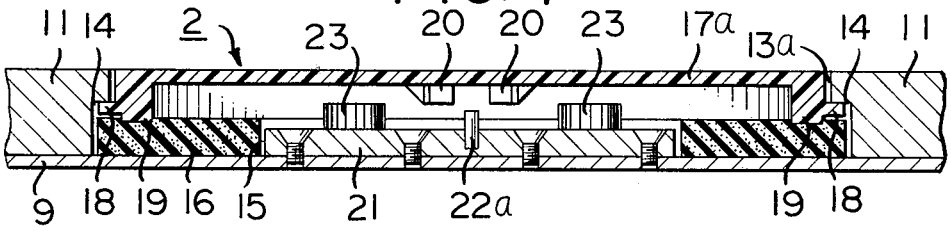
FIG. 4 is an enlarged longitudinal view of FIG. 2 taken on line IV—IV.

Turning to FIGS. 2 through 4, the sensing means 2 will be detailed. To the open upper end portion of the body 1 is attached an annular flange 7 which is secured to the side portion of body 1 by means of screws 8. On the flange 7 is attached a metal plate 9 which is secured thereto by means of screws 10. On the metal plate 9 is attached the sensing means 2. Sensing means 2 comprises a resilient frame 11, such as a rubber disk or the like member, which is secured to the metal plate 9 by means of screws 12. In the resilient frame 11 are formed, at its radial region, openings 13*a*, 13*b*, 13*c* and 13*d* of equal area in a equally spaced relationship and, at its central region another opening 13*e*. The upper periphery of respective openings 13*a*, 13*b*, 13*c*, 13*d* and 13*e* projects inwardly to form a looped supporting step 14. Inside respective openings 13*a*, 13*b*, 13*c*, 13*d* and 13*e* is located a resilient material 16 made of urethan foam, which resilient material lies on the metal plate 9 and is provided with a central hole 15. Above corresponding resilient materials 16 are disposed beat plates 17*a*, 17*b*, 17*c*, 17*d* and 17*e* which are movably inserted into the openings 13*a*, 13*b*, 13*c*, 13*d* and 13*e*. The upper surface of beat plates 17*a*, 17*b*, 17*c*, 17*d* and 17*e* is leveled substantially with that of the resilient frame 11. The beat plate is integrally constituted, at its outer periphery, with a circular flange 18 adapted to be engaged with the supporting step 14 and at its lower rim surface, with a circular projection 19 which is in contact with the resilient material 16 so as to assure an occurate sensing of a fine beating force. Instead of having an equi-level annular contact surface, the circular projection 19 may be provided with either a multi-stepped or gradually-inclined annular contact surface. Alternatively, resilient material 16 may have a circular projection with an annular contact surface of the above-mentioned configuration when the beat plate 17 is without a projection. For further alternation, both the beat plate 17 and resilient material 16 may be provided with the circular projections.

Among the beat plates, four beat plates 17*a*, 17*b*, 17*c* and 17*d* each have either a plurality of magnets or an annular magnet 20 secured to the substantially central portion of their lower surface. In the resilient material 16, at a region thereof confronting the magnet 20, is formed the hole 15 into which a supporting base 21 is fittingly inserted the base 21 being secured to the metal plate 9 with screws. Individual supporting bases 21 are provided correspondingly with sensing elements 22*a*, 22*b*, 22*c* and 22*d* composed of Hall elements at their centers. Symmetrically with respective sensing elements 22*a*, 22*b*, 22*c* and 22*d* are disposed two stoppers 23 made of rubber or the like material so that the beat plates 17*a*, 17*b*, 17*c* and 17*d* are prevented to be lowered beyond a predetermined level. Further, a sensing element 22*e* is provided on the metal plate 9 positioned under the central beat plate 17*e*, and said sensing element includes a switch alone. The beat plates, 17*a*, 17*b*, 17*c*, 17*d* and 17*e*, which are included by the sensing means 2 constructed in the above-mentioned fashion serve respectively as a low conga portion 24*a*, a high conga portion 24*b*, a low bongo portion 24*c*, a high bongo portion 24*d* and a glissando portion 24*e* to generate such a sound that is generated by rubbing the beat plate with finger tips. (hereinunder will be referred to as glissando). Beat plates 17*a*, 17*b*, 17*c*, 17*d* and 17*e* are blanketed with a cover 25 which is made of synthetic rubber, cloth or the like material and which is printed with beating position marks or a pattern. The peripheral portion of cover 25 undergoes a tension by means of screws 26 fixed to the body 1. See FIG. 1.

Figure 5:
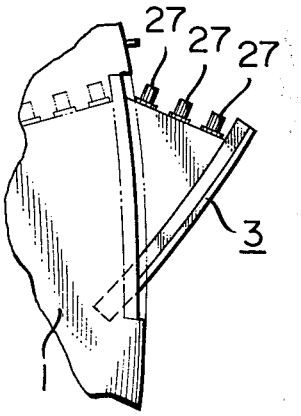
FIG. 5 is a side view of an operation means pulled out of the instrument body.

As shown in FIG. 5, the operation means 3 has provision of operation buttons or knobs 27 for actuation of a power source, a rhythm selection mechanism, a volume and a tone controlling means, respectively and all said buttons or knobs are installed on a panel which can appear outside of the body and disappear to inside thereof by means of a hinge or the like.

Figure 6:
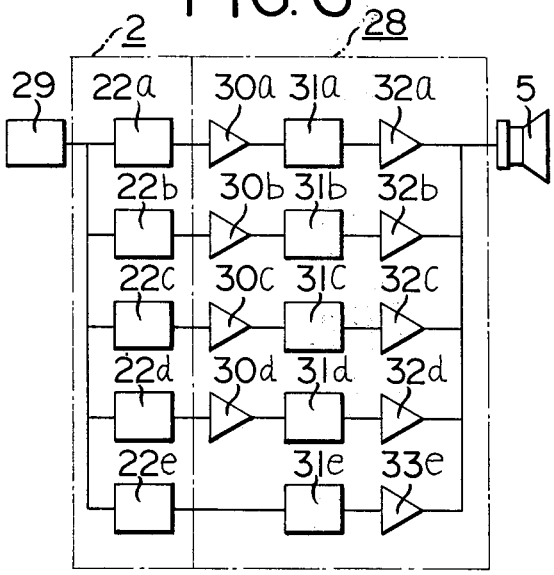
FIG. 6 is a block diagram of an electric circuit of the electronic percussion instrument embodying the invention.

Electric circuit 28 incorporated in the body 1, as shown in FIG. 6, comrises a power source 29, sensing elements 22*a*, 22*b*, 22*c*, 22*d* and 22*e* which are supplied with power by the power source 29 and whose outputs are connected via amplifiers 30*a*, 30*b*, 30*c* and 30*d* to oscillation circuits 31*a*, 31*b*, 31*c*, and 31*d* respectively with oscillation circuit 31*e* directly connected to sensing element 22*e* and respectively for producing a low conga sound, high conga sound, low bongo sound, high bongo sound and glissando which in turn are connected to output amplifiers 32*a*, 32*b*, 32*c*, 32*d* and 32*e*, and a entire band speaker 25 for converting output signals from the output amplifiers into percussion instrument sounds. In addition thereto, it is deemed preferable to provide plural speakers, instead of said one single speaker 5, for use separately in a low-pitched tone, a medium-pitched tone and a high-pitched tone in accordance with the tone quality, so as to connect thereof with the respective amplifiers separately. Although not shown in FIG. 6, the electric circuit 28 may be incorporated with additional circuits for ticking rhythm and for applying vibrations.

In operation, when a player beats through cover 25 one of the beat plates 17*a*, 17*b*, 17*c* and 17*d* or some of them at the same time by way of applying a pertinent beating force to usual instruments such as bongo, conga and the like, a beat plate or plates subjected to the application of beating force are lowered with their circular projections 19 urged to the resilient materials 16 in opposition to elasticity thereof. For convenience of explanation, take beat plate 17*a* as a beat plate undergoing the application of beating force, for example. Concurrently with lowering of the beat plate 17*a*, the magnet 20 of beat plate 17*a* approaches the sensing element 22*a* composed of a Hall element. Then, in the sensing element 22*a*, an output is produced which is substantially proportioned to the amount of displacement of the beat plate 17*a* by the aid of characteristics of Hall element. Therefore, if the beat plate 17*a* is beaten softly, a small output is obtained. With a slightly large beating force, an output becomes large slightly. A large beating force results in a large output. The output will be amplified in amplifier 30*a*.

An output of amplifier 30*a* is used for driving oscillation circuit 31*a* to produce an oscillation output therefrom which in turn is delivered via amplifier 32*a* to the speaker 5, thereby producing a sound. In this manner, when the beat plate 17*a* is beaten softly, a small output of sensing element 22*a* is obtained thereby to merely produce a small sound; and in addition, since the circular projection 19 is prevented to be urged into the resilient material 16 beyond a predetermined limit, the beat plate 17*a* never fails to undertake substantially the same amount of displacement even when it is beaten with slightly fluctuated beating forces, thereby maintaing substantially constant the strength of sounds from speaker 5.

When the beat plate 17*a* is beaten with a large beating force, the circular projection 19 is urged deeply into the resilient material 16 so that the sensing element 22*a* produces a large output, thereby producing a large sound corresponding thereto.

In case where the circular projection 19 has the multistepped contact surface, the strength of sound can be varied stepwise; where the inclined contact surface is employed, the strength of sound can be varied with the inclination angle and configuration of the inclined contact surface.

Needless to say, other beat plates 17*b*, 17*c*, 17*d* operate in cooperation with associated devices as the beat plate 17*a* does.

Next, the operation for producing a glissando tone sound will be described. When depressed, the beat plate 17*e* is lowered in opposition to the resilient material 16 so that sensing element 22*e* constituted by a switch is closed. In response to actuation signal from a sensing element 22*e*, an oscillation circuit 31*e* for use in producing a glissando oscillates by itself to effect an output which is amplified by an output amplifier 33*e* in order to let a speaker 5 make utterance of a glissando.

While, in the foregoing description, one embodiment has been explained wherein the oscillation circuits 31*a*, 31*b*, 31*c*, 31 *d* and 31*e* are driven to oscillate only when they receive the outputs from the sensing means 2, oscillation circuits constantly oscillating may be used together with a gate circuit which is normally set to cut-off condition and is opened in response to the output from the sensing means 2.

It should be understood that the foregoing embodiment has been explained by way of bongo and conga drums but the invention may be applicable to other instruments producing sounds by means of the application of beating force, such as drums, pianos and so on.

What is claimed is:

1. An electronic percussion instrument comprising:

a support plate;

a sensing element comprising a Hall element and means fixedly locating said Hall element on said support plate;

resilient means supported with respect to said support plate and extending laterally beyond said Hall element;

a beat plate overlying said Hall element and movably supported by said resilient means;

a magnet pendently secured to the underside of said beat plate near said Hall element and displaceable toward the Hall element by a beating force applied to said beat plate for causing a corresponding Hall element output;

an oscillator means for generating a sound signal like that of a percussion instrument upon being enabled by said output of said Hall element;

an amplifier means for amplifying an output sound signal from said oscillator means;

a speaker for converting the amplified sound signal from said amplifier means into the sound of such a percussion instrument.

2. An instrument according to claim 1, including a plurality of Hall elements circumferentially distributed on said support plate, a plurality of beat plates correspondingly circumferentially distributed over said support plate and each overlying a corresponding Hall element and pendently supporting at least one magnet adjacent and cooperatively with respect to the corresponding Hall element, means connecting each Hall element with a corresponding oscillator arranged to individually produce a sound signal, wherein each such oscillator produces a sound signal corresponding to a percussion instrument of different tone quality and color, respectively corresponding to two bongo tones of different pitch and two conga tones of different pitch.

3. The apparatus of claim 1, in which said resilient means comprises a sheet of synthetic resin foam lying on said support plate and having a substantially central opening loosely surrounding a zone occupied by said Hall element, said beat plate being shaped substantially as a shallow, downwardly opening cup having a wide platelike central portion and a downwardly extending peripheral wall of substantially narrower cross section, said peripheral wall axially opposing said foam sheet, said beat plate including a radially extending peripheral flange on the outboard face of said peripheral wall and which overlies said resilient foam sheet, projection means interposed between opposed surfaces of said beat plate peripheral wall and resilient foam sheet and being a part of one thereof for normally spacing said radial flange above the surface of said foam sheet when no beating force is applied to said beat plate, a disklike frame of rubberlike material fixed atop said support plate and having an opening therethrough for receiving and peripherally bounding said beat plate and resilient foam sheet, said disklike frame having an inwardly projecting step at the periphery of the opening therein, said step engaging the top of said beat plate flange and being so spaced above said resilient foam sheet as to snugly hold axially together said beat plate peripheral wall and said foam sheet through said projection means, without interferring with downward movement of said beat plate into compressing relation with said foam sheet.

4. The apparatus of claim 3, including a pair of rubberlike stopper members and means fixedly mounting said stopper members and Hall element atop said support plate, said mounting means being disposed within the substantially central opening of said foam sheet, said stopper members being disposed in laterally flanking, spaced relation with respect to said Hall element and being spaced laterally outboard of said magnet, said stopper members having upper ends normally spaced below the central portion of said beat plate, the upper ends of said stopper members lying somewhat above the upper end of said Hall element such that downward movement of said beat plate, upon application of a beating force thereto and as permitted by compression of said foam sheet by said beat plate peripheral wall, will be limited by bottoming of the central portion of said beat plate on said stopper members prior to physical engagement of the beat plate with the Hall element.

5. The apparatus of claim 4, in which said disklike frame and stopper members are rubber and said resilient foam sheet is urethane foam.

6. The apparatus of claim 3, in which said projection means is a downwardly projecting portion of said peripheral wall of said beat plate, said downward projection extending below said radial flange of said beat plate and normally being held in at least firm engagement with the upper surface of said foam sheet by overlying contact of said flange by said step of said disklike frame.

7. The apparatus of claim 3, in which the top of said beat plate, when in its rest position, is substantially flush with the top of said disklike frame, and including a thin cover sheet extending across the top of said disklike frame and beat plate and having a peripheral portion extending downwardly along the periphery of said disklike frame, said apparatus having a body supporting said support plate and means on said body below said cover sheet for engaging the periphery thereof and tensioning same.

* * * * *